United States Patent [19]

Hull et al.

[11] Patent Number: 5,054,718

[45] Date of Patent: Oct. 8, 1991

[54] STUNT KITE BRIDLE

[76] Inventors: Harold L. Hull, 401 Canyon Way, Sparks, Nev. 89434; Anthony R. Cocucci, 645½ N. Center St., Reno, Nev. 89501

[21] Appl. No.: 668,910

[22] Filed: Mar. 13, 1991

[51] Int. Cl.[5] ..... B64C 31/06

[52] U.S. Cl. ..... 244/155 A; 244/155 R

[58] Field of Search ..... 244/153 R, 155 R, 155 A

[56] References Cited

U.S. PATENT DOCUMENTS 3,338,536 8/1967 Hull et al. ..... 244/155 A 3,421,722 1/1969 May et al. ..... 244/155 A 4,736,914 4/1988 Tabor ..... 244/153 R 4,871,133 10/1989 Alonso ..... 244/153 R

*Primary Examiner*—Joseph F. Peters, Jr.

*Assistant Examiner*—Linda L. Palomar

[57] ABSTRACT

A kite apparatus which may be attached to the center spar of a stunt kite which allows the common string of the two yokes to pass through a pulley and when one of the kite control strings is pulled, the common string rides over the pulley causing un-equal lengths of the common string on each side of the pulley, thus changing the attack of the surface of the kite to the wind which provides a new and unusual control resulting in better maneuverability.

12 Claims, 2 Drawing Sheets

STUNT KITE BRIDLE

FIELD OF THE INVENTION

This invention relates to kites and more particularly to kite bridles for two string kite bridles.

BACKGROUND OF THE INVENTION

Kites and bridles for kites are well known in prior art ( such as the steerable kite of U.S. Pat. No. #4,874,146, the kite bridle of U.S. Pat. No. #4,871,133 or the two-string delta-style kite of U.S. Pat. No. #4,736,914.

In recent years, two string stunt kites have become increasingly popular and much attention has been given to the problems inherent in using two strings to control and maneuver the kite under adverse conditions such as high winds, cross winds or changing winds and with the interest and increased activity of competition flying, more attention is being given to precision flying, response time and other variables connected with flying.

In the past, it has been the common practice to attach the bridle control loops to the two lateral rods in two places and in one place on the center strut or keel tube of the frame, forming substantially two, equal, three string yokes, with each yoke pulling on substantially one side of the kite and dividing the kite into two chambers or surfaces. A control string is attached to a common point of each of the two yokes, and when, for steering, one of the two strings is tensioned more than the other, the respective corresponding half of the steerable kite is drawn near which has the result that, because of the two-chamber system, the air current is intensified in the other half of the kite, and when the selected steering position is maintained (right or left) circular motions are generated.

When both control stings are simultaneously held at the same length, the kite moves in the direction indicated by its tip.

One problem occurring with the prior art practice of having two independent yokes, is the fact that the plane of the kite can only be controlled in its horizontal axis, that is, no variable control is available to change the manner in which each yoke is attached to the kite while in flight. All the strings of each yoke remain at the same length from the contact points on the kite rods to the common tie point on each of the yokes. On the other hand, a three string kite which is capable of changing the kite in its horizontal and vertical axis is cumbersome and requires means such as reels to control each of the three strings as is demonstrated by U.S. Pat. No. #3,338,536.

SUMMARY OF THE INVENTION

The present invention addresses the problem of changing the two, three yoke strings while in flight and is a compromise between a two-string kite and a three-string kite.

It is therefore, a primary object of the present invention to provide a means to change the attack of the two chambers or surfaces of a kite while in flight without a third string.

It is a further object to provide a means for the two yokes to interact while in flight.

A further object is to provide an adjustable stop on the string which is common to both yokes.

Still another object is to provide means to control not only the horizontal angle of attack but to also change the vertical angle of attack.

Yet another important object is to increase the maneuverablity of the prior art two-string kite.

A further object is to reduce the wind pressure against the kite by changing the angle of attach when cornering by "dumping" the wind and reducing drag.

Another object is to reduce tension on the strings when in a tight maneuver to reduce breakage of control strings.

Still another object is to require less pull on the control strings for the operator when maneuvering.

A most important object is to provide a pulley or wheel which may be removably attached to the center strut of a three strut kite which cooperates with the common string of the two yokes whereby the common string may be shortened on one side of the pulley while being lengthened on the other while in flight.

Another object is to provide guides associated with the mount of the pulley or wheel to contain and guide the common yoke string around the pulley or wheel.

Still another object is to provide a mount for the pulley or wheel which may be attached to the center strut of a three strut kite which is slidable on the strut and which may be positioned on the strut without the use of tools or bolts and nuts or other permanent fastening means.

Yet another object is to provide a simple, economical bracket and wheel assembly which may be made out of metal or plastic and manufactured by injection molding or by a blank, pierce and form die.

Other objects and advantages will become apparent when taken into consideration with the following drawings and specifications.

DETAILED DESCRIPTION OF THE DRAWINGS

Figure 1:
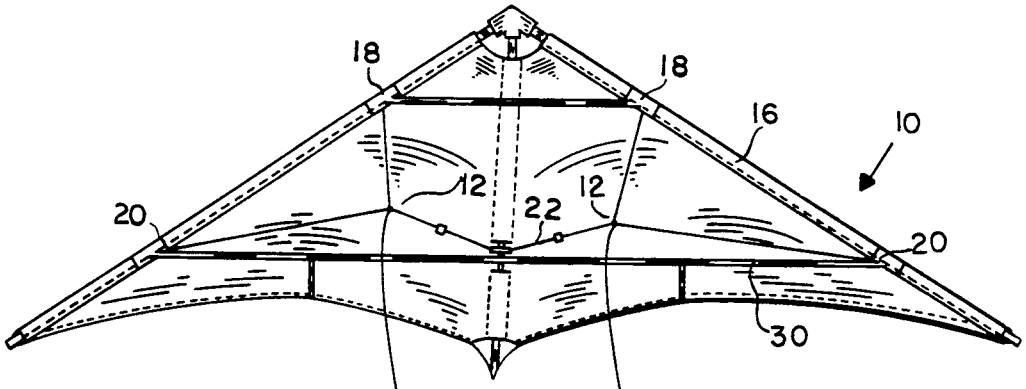
FIG. 1 is a perspective view of the present invention attached to a three, strut kite.
Figure 3:
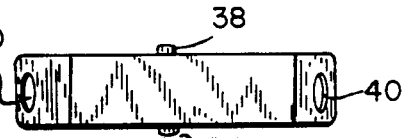
FIG. 3 is a top view of the device.
Figure 2:
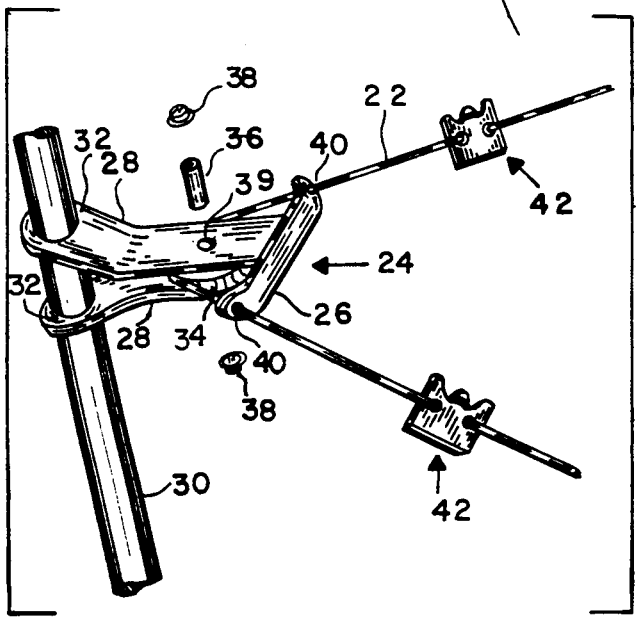
FIG. 2 is a perspective view of the device mounted on a spar of a kite, including stop means mounted on the common yoke string.
Figure 4:
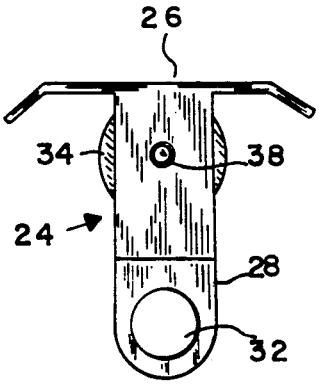
FIG. 4 is a side view of the device.
Figure 5:
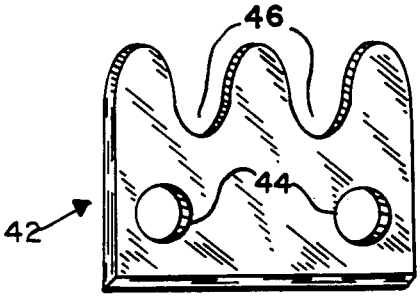
FIG. 5 is a perspective view, drawn to a different scale, of the preferred embodiment of a string stop means.
Figure 6:
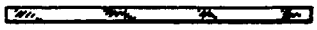
FIG. 6 is an end view of the string stop means.
Figure 7:
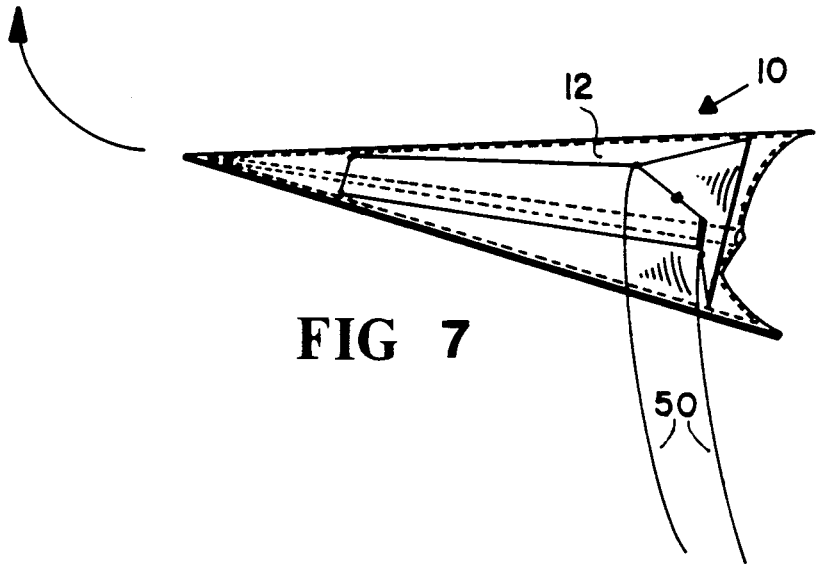
FIG. 7 is perspective view of a kite making a turn.
Figure 8:
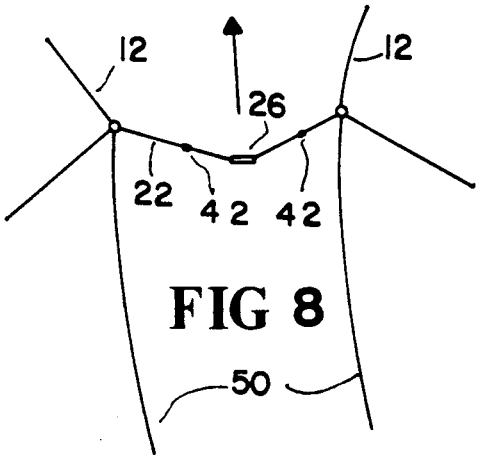
FIG. 8 is a plan view showing the yokes in a neutral position which causes the kite to climb straight up.
Figure 11:
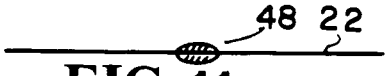
FIG. 11 is a second embodiment of a string stop.
Figure 9:
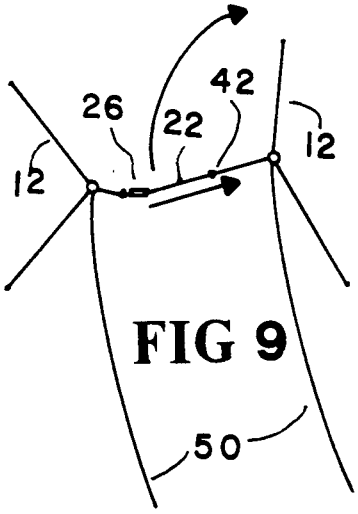
FIG. 9 is a plan view showing the yokes in a right hand turn position.
Figure 10:
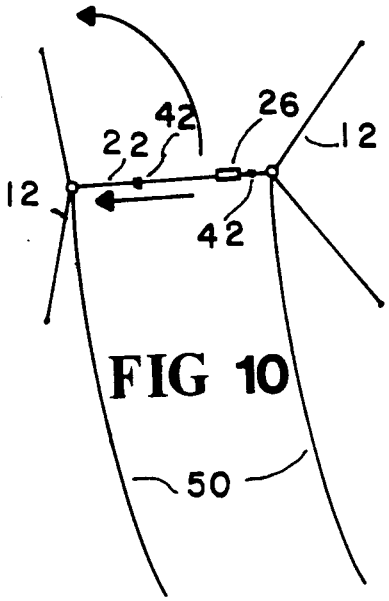
FIG. 10 is a plan view showing the yokes in a left hand turn position.

Referring now to the drawings in detail wherein like characters refer to like parts throughout the various drawings, 10 in FIG. 1 is a general view of a stunt kite with string yokes 12 being attached to the outer spars 14 and 16, respectively, at points 18 and 20, respectively, with the common string 22 of yokes 12 being captured by device 24, 26 being a mounting bracket with the two legs 28 being formed at an angle to provide a tensioned position of the legs 28 on center spar 30, holes 32 in legs 28 cooperate with spar 30 whereby when the two legs 28 are manually compressed toward each other, the mounting bracket 26 is temporarily released from spar 30 and may be re-located on spar 30, thus providing an adjustable mounting feature of the location of the mounting bracket 26 in relation to spar 30. Pulley or wheel 32 is mounted on bracket 26 by pin 36 and axle nuts 38, through holes 39 while 40 are guide holes for string 22 with 42 being the preferred embodiment of an adjustable string stop with holes 44 and indents 46 providing a path for string 22. In FIG. 11, 48 is a second embodiment of a string stop such as a split shot (as is used on fishing line for a sinker) which may be removably mounted on string 22.

It will now be seen that the mounting bracket 26 can be slid over the center spar of a kite and located wherever desired along the spar with no modification of the spar or kite and requiring no tools for mounting or relocating the bracket along the spar. By moving the location of the mounting bracket, the attack angle of the kite is changed which gives an additional control heretofore unavailable. The common string of the yokes, instead of being permanently affixed to the center spar, as is common in prior art, can now be captured by pulley 34 and guides 40 and when the two control kite strings 50 are pulled one way or another, the kite will maneuver as shown in FIGS. 7, 8, 9, and 10.

It will also be seen that we have provided a means to increase the maneuverablity of a kite to perform in a superior manner heretofore unknown.

It will also be seen that we have provided a bracket, pulley and string stop means which is economical to manufacture out of metal or plastic.

Of primary importance is the fact that we have provided a means to change the attack of the two chambers or surfaces of the kite while in flight to provide not only horizontal change but vertical change and without using a third control string.

Although the invention has been shown and described in what is conceived to be the most practical and preferred embodiment, it is recognized that departures may be made therefrom within the scope and spirit of the invention, which is not to be limited to the details disclosed herein but is to be accorded the full scope of the claims so as to embrace any and all equivalent devices and apparatus.

Having described our invention, what we claim as new and desire to secure by letters patent is:

1. A kite apparatus comprising; a bracket, mounting means to mount said bracket directly on a spar of a kite, a pulley, mounting means to mount said pulley to said bracket, a double yoke, said yokes being suitably affixed to said kite with at least one of their strings being common to both yokes, said common string being captured by said pulley, said common string having a first and second position, said first position dividing said common string into two substantially equal lengths by said pulley, said second position dividing said common string into two substantially un-equal lengths by said pulley, at least two control strings, said control strings being suitably attached at one of their ends to a common tie point on each of said yokes, respectively, whereby, when one of said control strings is tensioned more than the other, said common string of said yokes will move from its said first position to its said second position.

2. The device of claim 1 in which said bracket has guide means for said common string.

3. The device of claim 1 in which said bracket is a substantially rectangular strip of resilient material, said material being folded over on itself forming two legs and a space between said legs, said legs being parallel on their attached upper portions, said upper portions capturing said pulley in said space between them, said legs being angled away from each other at their distal ends, said distal ends having holes cooperating with said kite spar, whereby, when said legs are tensioned toward each other said bracket is released from said spar.

4. The device of claim 1 in which said mounting means to mount said pulley to said bracket is by a shaft and axle nuts.

5. The device of claim 1 including at least two stop means attached to said common string.

6. The device of claim 5 in which said stop means is a substantially square member, said member being made of a substantially thin material, said member having at least two holes cooperating with said common string.

7. The device of claim 6 in which said member has at least two indents to further capture and hold said common string.

8. The device of claim 5 in which said stop means are split shot.

9. The device of claim 1 in which said bracket and said pulley are made of metal.

10. The device of claim 1 in which said bracket and said pulley are made of plastic.

11. The device of claim 5 in which said stop means is made of metal.

12. The device of claim 5 in which said stop means is made of plastic.

* * * * *